US009155676B2

(12) United States Patent
Schwaiger-Shah

(10) Patent No.: US 9,155,676 B2
(45) Date of Patent: Oct. 13, 2015

(54) DEVICE WHICH PERMITS SLIMMING BY IMPROVING BLOOD FLOW IN THE ABDOMEN AREA

(76) Inventor: Manfred Schwaiger-Shah, Langenlois (AT)

( * ) Notice: Subject to any disclaimer, the term of this patent is extended or adjusted under 35 U.S.C. 154(b) by 566 days.

(21) Appl. No.: 13/429,870

(22) Filed: Mar. 26, 2012

(65) Prior Publication Data

US 2012/0226208 A1 Sep. 6, 2012

Related U.S. Application Data

(63) Continuation of application No. PCT/EP2009/062559, filed on Sep. 28, 2009.

(51) Int. Cl.
*A61H 7/00* (2006.01)
*A61H 9/00* (2006.01)

(52) U.S. Cl.
CPC ..... *A61H 9/0078* (2013.01); *A61H 2201/165* (2013.01); *A61H 2205/083* (2013.01)

(58) Field of Classification Search
CPC ..... A61H 7/00; A61H 9/00; A61H 9/0078
USPC ..... 601/143–144, 148–152; 128/96.1, 99.1, 128/100.1, 101.1, 118.1, 876, DIG. 20; 602/13, 19; 606/201, 202
See application file for complete search history.

(56) References Cited

U.S. PATENT DOCUMENTS

| | | | | |
|---|---|---|---|---|
| 3,071,133 | A * | 1/1963 | Eisen | 602/13 |
| 3,670,723 | A * | 6/1972 | Simjian | 601/152 |
| 4,703,750 | A * | 11/1987 | Sebastian et al. | 602/13 |
| 5,174,281 | A * | 12/1992 | Lee | 601/45 |
| 6,010,470 | A * | 1/2000 | Albery et al. | 601/152 |
| 6,254,556 | B1 * | 7/2001 | Hansen et al. | 601/149 |
| 7,591,797 | B2 * | 9/2009 | Hakonson et al. | 602/13 |
| 2011/0087263 | A1 * | 4/2011 | Arber | 606/202 |

FOREIGN PATENT DOCUMENTS

| | | | |
|---|---|---|---|
| DE | 3238425 | A1 | 4/1984 |
| DE | 3622987 | A1 | 1/1988 |
| JP | 2004105663 | | 4/2004 |
| WO | 0219954 | A2 | 3/2002 |
| WO | 03030808 | A1 | 4/2003 |
| WO | 2007137313 | A1 | 12/2007 |

OTHER PUBLICATIONS

Machine Translation of WO2007137313, dated Sep. 19, 2014.*
International Search Report issued in connection with PCT Application No. PCT/EP2009/062559 mailed on May 6, 2010.
Patent Examination Report No. 1 issued in Australian Patent Application No. 2009352957 on Sep. 4, 2014.
Patent Examination Report issued in Canadian Patent Application No. 2,775,469 on Feb. 17, 2015.

* cited by examiner

*Primary Examiner* — Justine Yu
*Assistant Examiner* — Christopher Miller
(74) *Attorney, Agent, or Firm* — Gesmer Updegrove LLP

(57) ABSTRACT

A device that permits slimming by improving blood flow in the skin, with movement by endurance training devices in the fat-burning pulse, with a main body with an attachment in the form of a sleeve for placing around the abdomen, wherein the main body has at least two chamber systems that can be acted on independently by a fluid, is improved by the fact that at least one and preferably two to four chambers of the chamber systems which come to lie on the right-hand side of the body are arranged in a U-shape with upwardly directed arms, whereas at least one and preferably two to four chambers of the chamber systems which come to lie on the left-hand side of the body are arranged in a U-shape with downwardly directed arms. This additionally stimulates peristalsis.

6 Claims, 1 Drawing Sheet

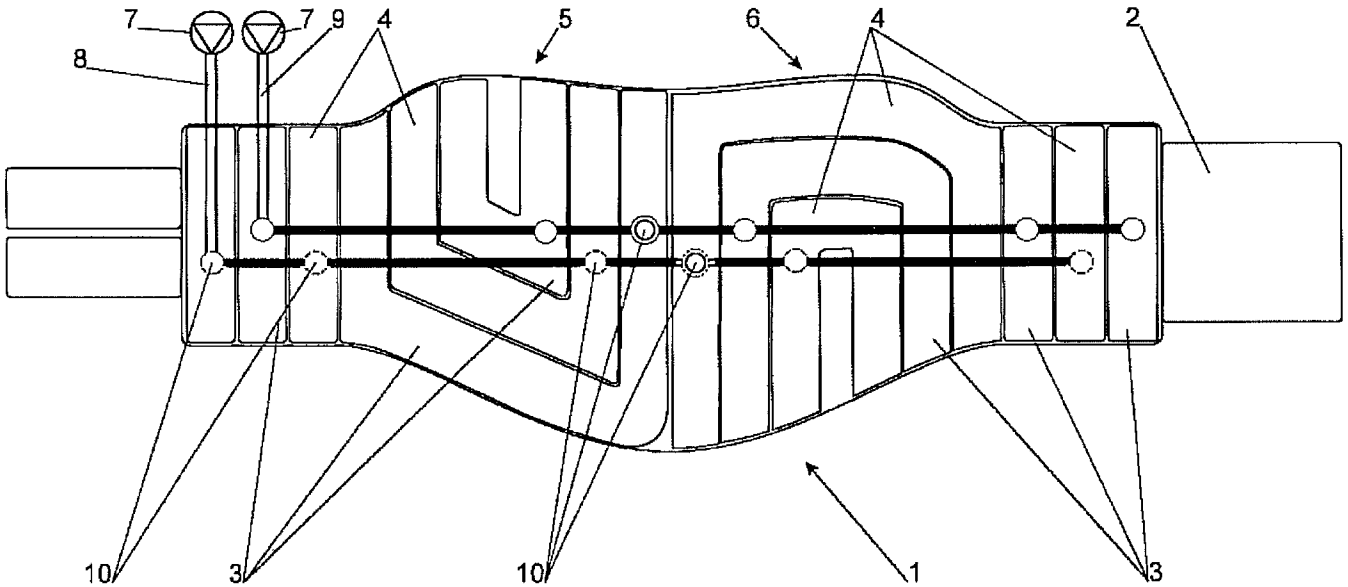
2
4
6
5
4
9
7
7
8
3
1
10
3
10

DEVICE WHICH PERMITS SLIMMING BY IMPROVING BLOOD FLOW IN THE ABDOMEN AREA

PRIORITY INFORMATION

The present invention is a continuation of PCT Application No. PCT/EP2009/062559, filed on Sep. 28, 2009, that is incorporated herein by reference in its entirety.

TECHNICAL FIELD

The present invention relates to a device which permits slimming by improving the blood flow in the skin with exercise by means of endurance training equipment using the fat-burning pulse, having a basic body with an attachment as sleeve for placing around the abdomen, the basic body having at least two chamber systems which can be supplied independently of each other with a fluid. The fluid is normally air.

STATE OF THE ART

Such known devices are intended to effect the breakdown of fat in specific body regions solely by promoting blood flow with simultaneous exercise using the fat-burning pulse. Behind this is the knowledge that the body preferably breaks down fat of those fat cells in which the blood flow is stronger.

Such devices are connected to at least one pump which pumps air or a fluid into the chamber systems.

Generally, this pump/these pumps is/are connected externally.

It is known for example from WO 03/030808 A to construct such fitness equipment as an item of clothing which is equipped with pressure chambers which are hollow chambers which can be subjected to low pressure, these pressure chambers being subjected to low and high pressure alternately independently of each other in order thus to produce a skin stimulation device.

Furthermore, fitness equipment is known from WO 2007/137313 A, in the form of a sleeve having at least two chambers which are independent of each other, wherein, by means of the at least two chambers—respectively main portion with a plurality of branch portions—said sleeve can be supplied rapidly with a fluid and also emptied again.

The effect targets exclusively skin stimulation and hence assists the blood flow. The tissue lying thereunder is in practice stimulated at the same time by this equipment.

All this equipment targets exclusively the blood flow of the tissue lying thereunder.

PRESENTATION OF THE INVENTION

It is the object of the present invention to produce a device for the problem zone of the abdomen, which, in addition to the effects of conventional equipment, acts not only on the skin but also on the peristalsis of the intestine.

According to the invention, this object is achieved by at least one, preferably two to four, chambers of the chamber systems which come to be situated on the right side of the body being disposed in a u-shape with downwardly pointing arms and, on the other hand, at least one, preferably two to four, chambers of the chamber systems which come to be situated on the left side of the body being disposed in a u-shape with downwardly pointing arms so that stimulation of intestinal peristalsis results.

Frequently, persons who have fairly large fat accumulations on the abdomen surface already suffer from the outset from underactivity of the colon. However, even in the case of intestinal peristalsis which can be regarded as normal, massage of the colon is helpful. In particular, intestinal gases can be made to pass through and finally be removed. As a result, the abdomen girth is reduced, in addition to burning fat.

In order to achieve this, the orientation or arrangement of the pressure chambers on the sleeve is crucial.

In order to pump the fluid into the chambers, it proves to be favourable that the supply is effected by one or more pumps and these are connected to the chamber system by tubes which open into the chambers at entry sites. If a plurality of pumps is provided, each can supply one chamber system so that no valves are required due to corresponding control. If only one pump is used, valves are required.

In the simplest case, by providing only two chamber systems which are supplied alternately with a fluid, the gases which are located in the colon pass through the colon and finally escape from the latter. For this purpose, it is important that, on the right side of the body where the ascending branch of the colon is located, the pressure chambers which are applied on the abdomen in this region have, according to the invention, arms which point upwards, and that, on the left side of the body where the descending branch of the colon is located, the pressure chambers which are applied on the abdomen in this region have, according to the invention, arms which point downwards. As a result of the fact that adjacent chambers are supplied in succession and consequently no constant pressure acts on one body region, stimulation of the peristalsis is effected.

Of course, it is also possible to use more than two chamber systems so that the intestine, similarly to a hose pump, experiences a more or less continuous forced stimulation.

It proves to be favourable if the entry sites of the fluid into the chambers are located in the vicinity of the transverse part of the u-shaped chambers, as a result of which the fluid adopts a preferred direction of flow. The colon is consequently stimulated in an intensified manner to convey the contents of the colon in the direction of the rectum.

In a preferred embodiment, the sleeve is designed as a belt and it proves favourable thereby if the fastener is configured as a VELCRO (hook-and-loop) fastener.

BRIEF DESCRIPTION OF THE DRAWINGS

The invention is explained in more detail subsequently with reference to a preferred embodiment which is represented in the accompanying FIGURE. The accompanying FIG. 1 shows a preferred embodiment variant.

BEST WAY TO CARRY OUT THE INVENTION

The device which permits slimming has a basic body 1 which is attached by means of an attachment 2, preferably configured as a VELCRO (hook-and-loop) fastener, as a belt on the body. This basic body 1 has two chamber systems 3 and 4 which are independent of each other. By means of one or more pumps 7, the two chamber systems 4 and 3 are supplied alternately with a fluid, normally with air, via tubes 8 and 9. For entry of the fluid into the chamber systems 3, 4, each chamber has entry sites 10 where it is connected to the tube 8 or 9. As an alternative to two pumps 7, the fluid can also be conducted alternately into the two chamber systems 3, 4 by one pump with the help of a valve. In order to stimulate peristalsis of the intestine, the arms of the three u-shaped chambers which come to be situated on the right half of the body 5 point upwards, as a result of which, in cooperation with the alternating supply to the chamber systems 3 and 4, peristalsis of the ascending portion of the colon is stimulated.

The three chambers which come to be situated on the left half of the body 6 have downwardly directed arms and here, in cooperation with the alternating supply to the chamber systems 3 and 4, peristalsis of the descending portion of the colon is stimulated.

Stimulation of intestinal peristalsis in the context of promoting blood flow in the tissue and this in the context of exercise by means of stamina training equipment using the fat-burning pulse, serves to permit slimming and induce well-being.

The invention claimed is:

1. A device for stimulating intestinal peristalsis, the device comprising:

a basic body with an attached sleeve member for placing the device around an abdomen, the basic body having at least two chamber systems which can be supplied independently of each other with a fluid, wherein each of the at least two chamber systems comprises:

at least one chamber situated on a right side of the basic body and disposed in a u-shape with upwardly pointing arms, at least one chamber situated on a left side of the basic body and disposed in a u-shape with downwardly pointing arms, and at least one non-u-shaped chamber situated on each of the right and left sides of the basic body, so that the device is configured to stimulate intestinal peristalsis.

2. The device according to claim 1, wherein a supply to the at least two chamber systems is effected by one or more pumps that are connected to the chamber system by tubes which open into the chambers at entry sites.

3. The device according to claim 1, wherein the at least two chamber systems are suitable to be alternately supplied with the fluid.

4. The device according to claim 1, wherein adjacent chambers are suitable to be supplied with the fluid in succession.

5. The device according to claim 2, wherein the entry sites of the fluid into the chambers are located in vicinity of a transverse part of the u-shaped chambers.

6. The device according to claim 1, wherein the sleeve is designed as a belt and is configured with a hook-and-loop fastener.

* * * * *